US007685953B2

(12) United States Patent
Giles

(10) Patent No.: US 7,685,953 B2
(45) Date of Patent: Mar. 30, 2010

(54) SYSTEM FOR RAPID, SECURE TRANSPORT OF CARGO BY SEA, AND MONOHULL FAST SHIP AND ARRANGEMENT AND METHOD FOR LOADING AND UNLOADING CARGO ON A SHIP

(75) Inventor: David L. Giles, Alexandria, VA (US)

(73) Assignee: Thornycroft, Giles & Co., Inc., Alexandria, VA (US)

( * ) Notice: Subject to any disclaimer, the term of this patent is extended or adjusted under 35 U.S.C. 154(b) by 18 days.

(21) Appl. No.: 12/037,230

(22) Filed: Feb. 26, 2008

(65) Prior Publication Data

US 2008/0202402 A1 Aug. 28, 2008

Related U.S. Application Data

(60) Provisional application No. 60/903,297, filed on Feb. 26, 2007.

(51) Int. Cl.
*B63B 25/00* (2006.01)

(52) U.S. Cl. ..... 114/72; 414/279; 701/23

(58) Field of Classification Search ..... 114/72, 114/121; 180/167, 168, 169, 170; 410/46; 701/23, 24; 414/279, 281
See application file for complete search history.

(56) References Cited

U.S. PATENT DOCUMENTS

| | | | | |
|---|---|---|---|---|
| 4,780,817 | A | 10/1988 | Lofgren | |
| 4,790,402 | A | 12/1988 | Field et al. | |
| 5,080,032 | A | 1/1992 | Giles | |
| 5,129,343 | A | 7/1992 | Giles | |
| 5,231,946 | A | 8/1993 | Giles | |
| 5,281,901 | A | 1/1994 | Yardley et al. | |
| 5,832,856 | A | 11/1998 | Giles | |
| 6,049,745 | A * | 4/2000 | Douglas et al. | 701/23 |
| 6,272,406 | B2 | 8/2001 | Alofs et al. | |
| 6,356,802 | B1 | 3/2002 | Takehara et al. | |
| 6,665,585 | B2 | 12/2003 | Kawase | |
| 6,799,099 | B2 | 9/2004 | Zeitler et al. | |
| 7,002,472 | B2 * | 2/2006 | Stratmoen et al. | 340/539.26 |
| 7,012,520 | B2 | 3/2006 | Webb, Sr. | |
| 7,044,247 | B2 | 5/2006 | Johansson et al. | |

(Continued)

OTHER PUBLICATIONS

International Search Report and Written Opinion; International Application No. PCT/US2008/002450; International Filing Date: Feb. 26, 2008.

*Primary Examiner*—Lars A Olson
(74) *Attorney, Agent, or Firm*—Antonelli, Terry, Stout & Kraus, LLP.

(57) ABSTRACT

A system for rapid, secure transport of cargo by sea includes a monohull fast ship and an arrangement for loading and unloading cargo through an opening in the stern of the ship and along a driving surface of a cargo carrying deck of the ship. The arrangement includes a self-propelled, automatically guided vehicle for carrying cargo to be transported during loading and unloading of the ship and a self-contained security scanning system on the vehicle for maintaining control and surveillance of cargo in transit on the vehicle. The ship includes a reader grid of ship communication system on the cargo carrying deck to which continued control and surveillance of the cargo can be handed off from the vehicle scanning system.

17 Claims, 14 Drawing Sheets

U.S. PATENT DOCUMENTS 7,101,139 B1 * 9/2006 Benedict ..... 414/281
7,308,114 B2 12/2007 Takehara et al.
2005/0248454 A1 11/2005 Hanson et al.
2008/0213073 A1 * 9/2008 Benedict et al. ..... 414/279

* cited by examiner

SYSTEM FOR RAPID, SECURE TRANSPORT OF CARGO BY SEA, AND MONOHULL FAST SHIP AND ARRANGEMENT AND METHOD FOR LOADING AND UNLOADING CARGO ON A SHIP

RELATED APPLICATION

This application claims priority under 35 U.S.C. §119 of provisional application Ser. No. 60/903,297 filed Feb. 26, 2007. The disclosure of the provisional application is hereby incorporated by reference.

BACKGROUND AND SUMMARY

Commonly owned U.S. Pat. Nos. 5,080,032; 5,129,343 and 5,231,946 disclose a monohull fast ship able to transport up to ten thousand tons of cargo at an average speed of 37 to 45 knots across the Atlantic Ocean in about three to four days in sea states up to 5, with a 10% reserve fuel capacity. The disclosures of these commonly owned U.S. patents are hereby incorporated by reference. While the high speed of these ships reduces the time for crossing the ocean, the efficiencies of transport of cargo by sea are effected not only by the speed of a ship but also the time to unload and load a ship in port before the ship can begin another transit. Prior art loading systems requiring cargo to be loaded from the top of the ship can require a time in port of one and a half days for loading and unloading.

Commonly owned U.S. Pat. No. 5,832,856, also hereby incorporated by reference, discloses a monohull fast ship with improved loading mechanism wherein a train of self-propelled trolleys are conveyed along one of rail pairs on the cargo carrying deck of the ship to decrease loading time in port from one and a half days down to six hours. However, the loading mechanism necessitates the use of docking facilities with rails to accommodate the trolleys moving to and from the ships and makes no allowance for meeting port/shipper security requirements. Additional time in port can be required for container inspection etc. to meet security requirements at the port and onboard the ship before putting to sea. There is a need for an improved system for rapid, secure transport of cargo by sea which allows the time in port for unloading and loading the ship and meeting security requirements to be further reduced and which permits the ship to be loaded and unloaded at docking facilities without rails. The present invention addresses this need.

A system of the invention for rapid, secure transport of cargo by sea comprises, in combination, an improved ship of the invention and an improved arrangement of the invention for loading and unloading cargo from the ship. Like the ship of Assignee's aforementioned patents, the ship of the present invention includes a hull producing a high pressure area at a bottom portion of a stern which rises from a point of maximum depth forward of a longitudinal center of the hull to a point of minimum draft at a transom which produces hydrodynamic lifting of the stern at a threshold speed above a length Froude Number of 0.40; sides of the hull at the datum waterline are non-convex in plan view with reference to a centerline of the ship; a length-to-beam ratio at the datum waterline is between 5 and 7.5 and a displacement to length ratio equal to a displacement of the hull divided by a cube of the length divided by 100 during operation of the hull in carrying fuel and payload is between 60 and 150 and a maximum operating Froude Number is between 0.42 and 0.9; a weather deck enclosing a top of the hull, at least one cargo carrying deck disposed below the weather deck and having a driving surface for self propelled, automatically guided vehicles transporting cargo to and from the ship through an opening in the stern of the ship and at least one lower deck disposed below the at least one cargo carrying deck; at least one water jet disposed within the hull with each water jet having an inlet in a bottom portion of the stern which produces high pressure during motion of the ship; and at least one power unit disposed on one of the at least one lower deck coupled to the at least one water jet for powering the at least one water jet to cause water to be drawn into the inlet of the at least one water jet to produce forward motion of the hull.

The improved arrangement of the invention for loading and unloading cargo through the opening in the stern of the ship and along the driving surface of the at least one cargo carrying deck includes at least one self-propelled, automatically guided vehicle for carrying cargo to be transported during loading and unloading of the ship, and a self-contained security scanning system on the at least one vehicle for maintaining control and surveillance of cargo in transit on the vehicle. Thus, the system is able to meet the recent substantial increase in the need for accurate security and tracking of containers and monitoring of their contents and of other cargo units at all times that the containers or cargo units are in transit on the vehicle during loading and unloading. This increase in security and tracking can reduce the time taken in port to load and unload containers/cargo units and process them through port security systems which necessarily depend upon random checks. The use of at least one self-propelled, automatically guided vehicle for carrying the cargo also eliminates the need for the use of rail pairs on the dock and in the ship. Because the vehicles in the disclosed embodiment move on rubber-tired wheels, without the need for rails, the ship can be loaded and unloaded at any normal roll on/roll off port. This reduces the effect of having to change port in the event of port closure by strikes or malfunctions of port facilities. It increases the flexibility of operations between different ports, rather than being restricted to those with specially installed rail systems of the prior art. These and other features of the invention make possible reduced in port time as discussed below, and provide an improved system and method for rapid, secure transport of cargo by sea.

The self-contained security scanning system on the at least one self-propelled, automatically guided vehicle of the arrangement for loading and unloading cargo according to a disclosed embodiment of the invention includes a reader and a field unit on the vehicle. The reader is capable of reading identification means, such as a tag unit, on a container/cargo carried by the vehicle and in turn communicates with the field unit. The field unit communicates with at least one of a ship server, a dockside server and a global data center.

The improved ship of the invention in the disclosed embodiment includes a reader grid having a plurality of readers in different, spaced locations along the at least one cargo carrying deck for reading the identification means on the cargo on the deck and for communicating readings of the individual cargo identification means to a ship communication system. Thus, once cargo with identification means is loaded on the deck of the ship by the automatically guided vehicle, surveillance of the cargo can be handed off from the automatically guided vehicle to the reader grid of the ship and the vehicle returned to the port dock. In the disclosed embodiment the ship communication system includes a ship server which communicates with global and local information centers, a super base on each cargo carrying deck which is linked to the ship server, and a plurality of a base stations on each cargo carrying deck communicating with respective ones of a plurality of groups of readers of the reader grid on the cargo carrying deck.

Guidance means are provided on the at least one cargo carrying deck of the ship for cooperating with guidance equipment of the at least one self-propelled, automatically guided vehicle carrying cargo for guiding the vehicle during loading and unloading the ship. The guidance means includes at least one of guide rails, electrical cable in grooves in the at least one deck in which different frequency signals are induced, and optical guidance means such as laser reflectors which cooperate with laser and optical scanning equipment on the vehicle.

The improved method for rapid, secure loading and unloading of cargo on a ship according to the invention comprises supporting cargo having identification means which can be remotely machine read on a self-propelled, automatically guided vehicle, transporting with the vehicle the cargo supported on the vehicle through an opening in the stern of the ship and along a driving surface of a cargo carrying deck of the ship, and reading the identification means on the cargo during the transporting with a self-contained security scanning system on the vehicle. As described above, in the disclosed embodiment the method further includes communicating the reading of the identification means from the vehicle to at least one of a ship server, a dockside server and a global data center. In addition, further reading of the identification means on the cargo is performed when the cargo is on the cargo carrying deck of the ship using a reader of a reader grid along the deck which communicates the further reading to a ship communication system thus handing off monitoring of the cargo/containers. This monitoring can continue within the ship at sea, the automatically guided vehicles being guided from the ship and remaining at port for loading and unloading the next ship in port.

Further features and advantages of the present invention will become more apparent from the following detailed description of an example embodiment of the invention taken with the accompanying drawings.

DETAILED DESCRIPTION

The system of the invention for rapid, secure transport of cargo by sea is illustrated in FIGS. 6-21. The system includes an improved ship of the invention depicted in FIGS. 6, 7, 14, 17 and 18 and an improved arrangement of the invention for loading and unloading cargo through the opening in the stern of the ship and along the driving surface of the at least one cargo carrying deck of the ship as illustrated in FIGS. 8-17 and 19-21. The system, ship and arrangement are improvements over that disclosed in commonly owned U.S. Pat. Nos. 5,080,032; 5,129,343; 5,233,946 and 5,832,856. However, the ship of the invention incorporates the improved loading efficiency of Assignee's prior patents as described below in connection with FIGS. 1-5. The improved arrangement for loading and unloading cargo of the invention includes at least one self-propelled, automatically guided vehicle for carrying cargo to be transported during loading and unloading of the ship. In this regard, the automatically guided vehicle of the invention is an improvement of a known self-propelled, automatically guided vehicle disclosed in U.S. Pat. No. 7,044,247, the disclosure of which is hereby incorporated by reference.

Figure 1:
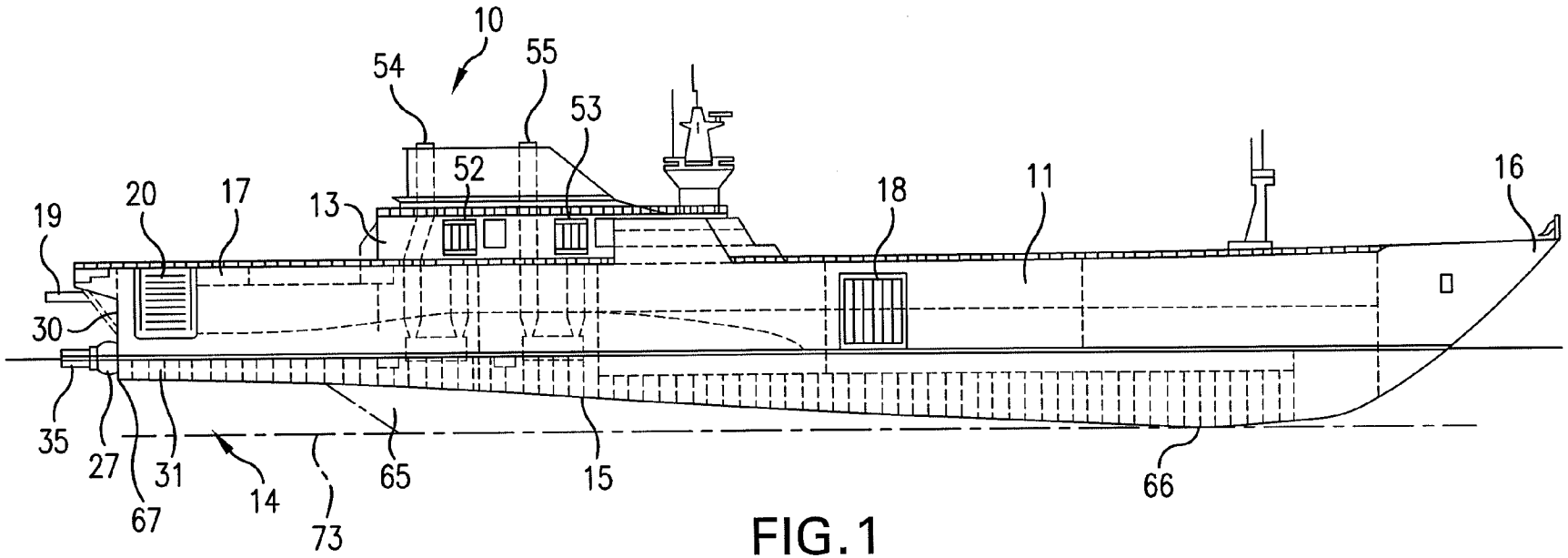
FIG. 1 PRIOR ART
FIG. 1 is a prior art side elevational or profile view of the starboard side of a ship in accordance with the aforementioned, commonly owned patents.
Figure 2:
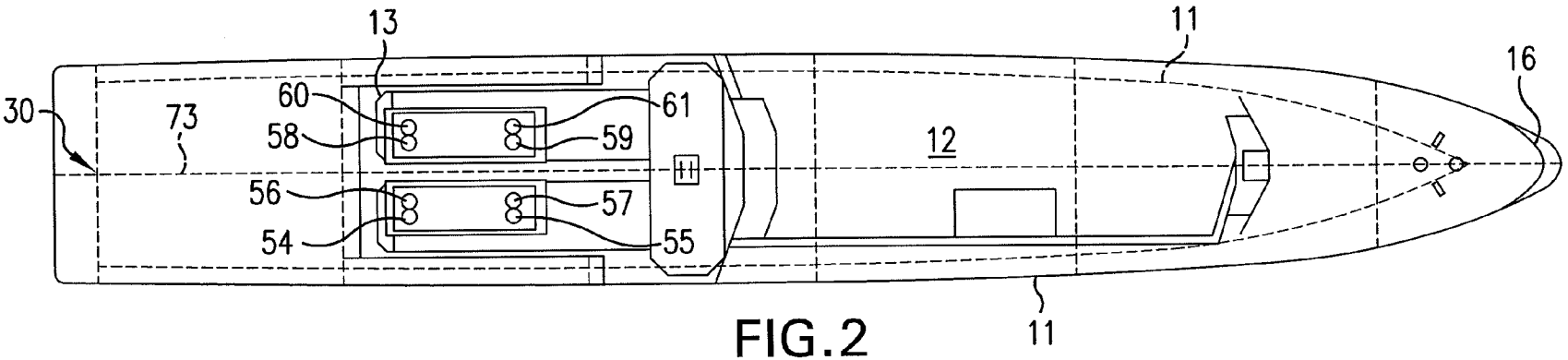
FIG. 2 PRIOR ART
FIG. 2 is a prior art top plan view of the ship shown in FIG. 1.
Figure 3:
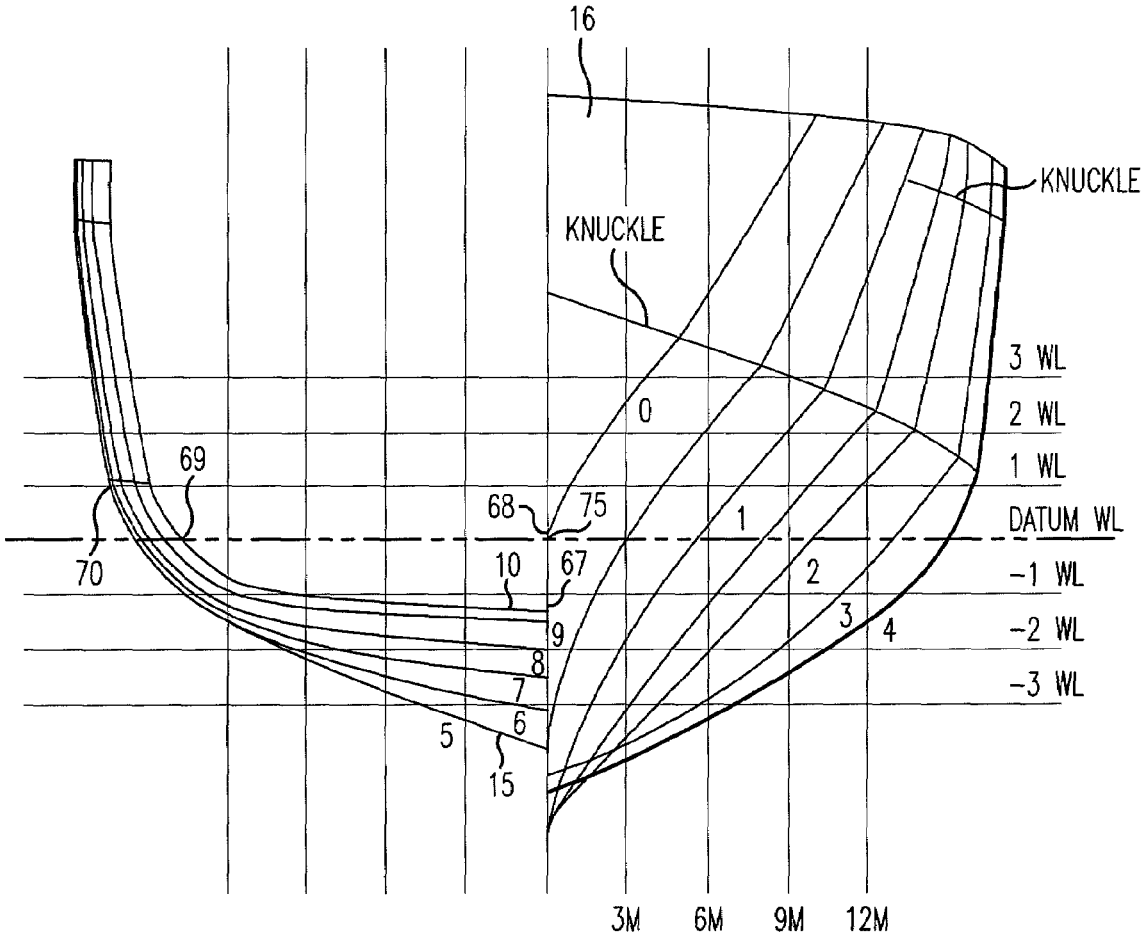
FIG.3 PRIOR ART
FIG. 3 is a presentation of the sections of the hull showing different contour lines at stations along the length of the hull shown in FIG. 1, half from the bow section and half from the stern section.

An understanding of the improved ship of the invention, is facilitated by an explanation of the ship of the aforementioned commonly owned U.S. patents illustrated in FIGS. 1-5. As shown in FIG. 1, the prior art ship 10 has a semi-displacement or semi-planning round bilge, with a low length beam ratio (L/B) hull form utilizing hydrodynamic lift at high payloads, e.g. up to 10,000 tons for transatlantic operation at speeds in the range of 40 to 50 knots. The L/B ratio is preferably between about 5.0 and 7.5. The ship has a water line length of over 215 feet and, as illustrated in FIG. 3, has a datum waterline length of 679 feet and a displacement length ratio between 60 and 150.

The ship 10 has a hull 11 known as a semi-planning round-bilge type with a weather deck 12. A pilot house superstructure 13 is located aft of amidship to provide a large forward deck for cargo and/or helicopter landing, and contains accommodations, living space and the controls for the ship as well as other equipment. The superstructure 13 is positioned so as not to adversely affect the longitudinal center of gravity. A commercial vessel is depicted in the form of a cargo ship an access of 2,000 tons displacement such as but not limited to 20-30 thousand tons.

The longitudinal profile of the hull 11 is shown in FIG. 1, a body plan is shown in FIG. 3. A base line 14 shown in dashed lines in FIG. 1 depicts how the bottom 15 of the hull 11 rises from a point of maximum depth toward the stern 17 and flattens out at the transom 30. The bottom 15 of the hull has a non-convex longitudinal profile with respect to the base line 14 from the point of maximum depth 66 to the point of minimum depth 67. This contour is also illustrated in sectional form in FIG. 3 and runs from a maximum depth (FIG. 3 ref. 66) to a point of minimum depth at the transom (FIG. 3 ref. 67) which is less than 60% of the depth at point 66, in order to provide the necessary high pressure for exceeding the threshold speed without incurring prohibitive transom drag at lower length Froude Numbers. This is a significant feature of the ship in providing the speed requirement which typically operates between Froude Nos. of at least 0.40 and preferably of 0.42 and 0.9.

FIG. 3 is a presentation of the sections of the monohull fast ship hull form of 679 feet datum waterline length with the right side showing the configuration at the forward section of the ship and the left side showing the configuration at the aft section. The drawing describes the cross-section of the hull in terms of meters from the beam centerline it also in tenths of the ship's length from the forward perpendicular 68 to the aft perpendicular 75. The hull has a traditional displacement hull shape with a keel in the forward section and a flattened bottom in the aft section. In smaller vessels, a centralline vertical keel or skeg 65 shown in phantom lines in FIG. 1 and designated by the numeral 65 maybe fitted, extending from about the deepest point of the forward bilge to a point about one-quarter to about one-third of the ship's length forward of the transom 30. This keel or skeg improves directional stability and roll damping in smaller ships. It is this hull configuration which produces at a threshold speed a hydrodynamic lift under the aft section to reduce drag in relation to conventional displacement hulls as demonstrated in FIG. 14 of the aforementioned commonly owned U.S. patents. At the transom (station or contour line 10), the distance between the ship's centerline (68) and its conjunction with the ship's side (69) is at least 85% of the distance of the centerline (68) and the point of maximum beam (70). This is in order to accommodate sufficient space for waterjet inlets, or propellers, to deliver the horsepower necessary for speeds of Froude Numbers equal to 0.42 to 0.9 particularly for larger ship size and displacement length ratio. Station or contour lines numbered 0-2 of FIG. 3 show the non-convex form of hull shape with associated "knuckle" in the bow section 16 viewed from right to left in FIG. 1, whereas the station or contours lines numbered 3-10 show how the bilge in the stern section 17 becomes progressively convex and flattened as also viewed from right to left in FIG. 1. Although there is presently no agreed method for determining the precise speed of onset of hydrodynamic lift as a result of the size and shape of this hull, it has been suggested that such lift is assisted by the flattening of these sections and its onset takes place at a speed length ratio of 1.0 or Froude Number of 0.298 or a threshold speed of about 26.06 knots at a displacement of 22,000 tons, in the case of the 679 feet waterline length hull. The waterline of the hull, in plan view (FIG. 3 ref. 71) is at all points non-convex with reference to the vessels centerline 73 in order to reduce slamming in the forward section while retaining maximum waterplane area for operating at higher displacement length ratio. The acute angle between the contour line 10 (transom) at the point of intersection with a horizontal transverse datum line is a maximum of 10%. The ship, as illustrated in FIG. 3, as a maximum operating speed of above 34.5 knots and has a maximum displacement of over 600 tons.

The round-bilge hull 11 thus has a "lifting" transom stern 17 which, as is shown, is produced by the hydrodynamic force resulting from the hull form which is generally characterized by straight entrance waterlines, rounded afterbody sections typically rounded at the turn of the bilge and non-convex aft buttock lines terminating sharply at the transom. This type of hull is not a planning hull. It is designed to operate at maximum speeds in the Froude Number range of 0.40 and preferably above about 0.42 and below about 0.9 by creating hydrodynamic lift at the afterbody of the hull by the action of high pressure under the stern but without excessive transom drag at moderate Froude Numbers of above about 0.42 to 0.6 within the "threshold" speed range, as characterizes known hulls which are intended for higher Froude Numbers.

The combination of bow sections which are fine at and below the waterline, with a deep forefoot (or forward keel) and full sections above the bow knuckleline are a major factor in reducing slamming accelerations and spray generation at the bow in high sea states. The high pressure at the stern also acts to dampen out excessive pitching, thus reducing longitudinal stress on the hull girder.

The hull 11 is also provided with an access ramp 18 amidship on the starboard side and stern roll-on/roll-off ramp 19 so that cargo stored at the three internal decks 21, 22, 23 below the weather deck 12, as illustrated on the midship section shown in FIG. 5, having interconnecting lifts (not shown) can be accessed simultaneously for loading and unloading. Other access ramps can be strategically located such as a ramp 20 provided on the starboard side aft.

Because of the shorter hull design, the hull will achieve required structural strength with greater ease than a long, slender ship for a given displacement. The shape which produces hydrodynamic lift in the hull 11 is well known and its dimensions can be determined by requirements of payload, speed, available power and propulsor configuration. A three-dimensional hull modeling computer program of a commercially available type can generate the basic monohull fast ship form with the foregoing requirements as inputs. Once the basic hull parameters are determined, an estimate of the displacement can be made using, for example, two-digit analysis with weight coding from the standard Shipwork Breakdown Structure Reference 0900-Lp-039-9010.

In addition, the shorter hull produces a higher natural frequency which makes the hull stiffer and less prone to failure due to dynamic stress caused by waves, while allowing, in combination with the propulsion system hereinafter described, achievement of speeds in the 40-50 knot range.

Water jet propulsors utilizing existing mixed flow, low pressure, high volume pump technology to produce very high thrust of the order of 200 tons are incorporated in the ship. The waterjet propulsors are driven by conventional marine gas turbines sized to obtain the higher power required. The waterjet propulsor presently contemplated for use is a single stage design which is uncomplicated in construction, and produces both high efficiency and low underwater noise at propulsion power in excess of 100,000 horsepower.

Figure 4:
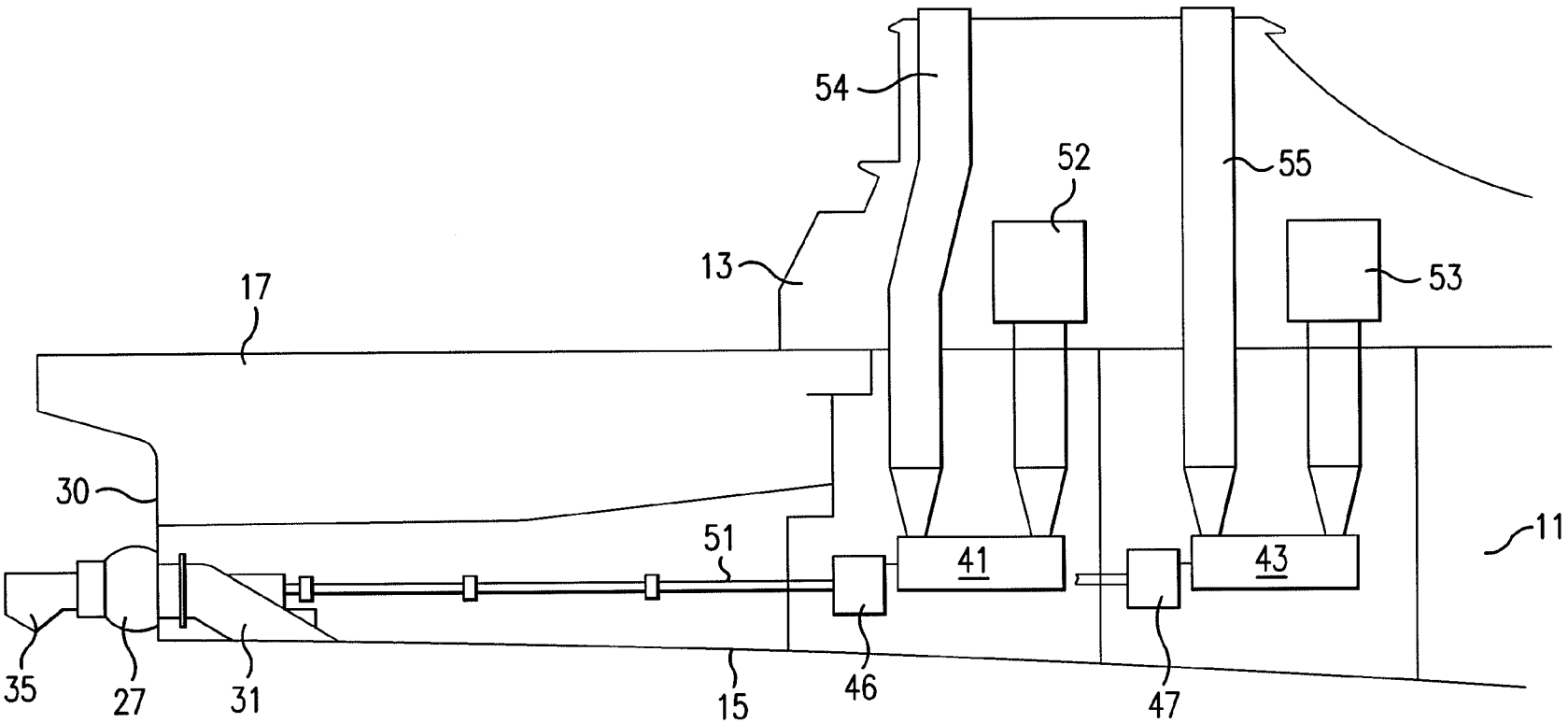
FIG.4 PRIOR ART
FIGS. 4 and 5 are respectively prior art schematic side elevational and top views showing the arrangement of the water propulsion/gas turbine units within the ship shown in FIG. 1.
Figure 5:
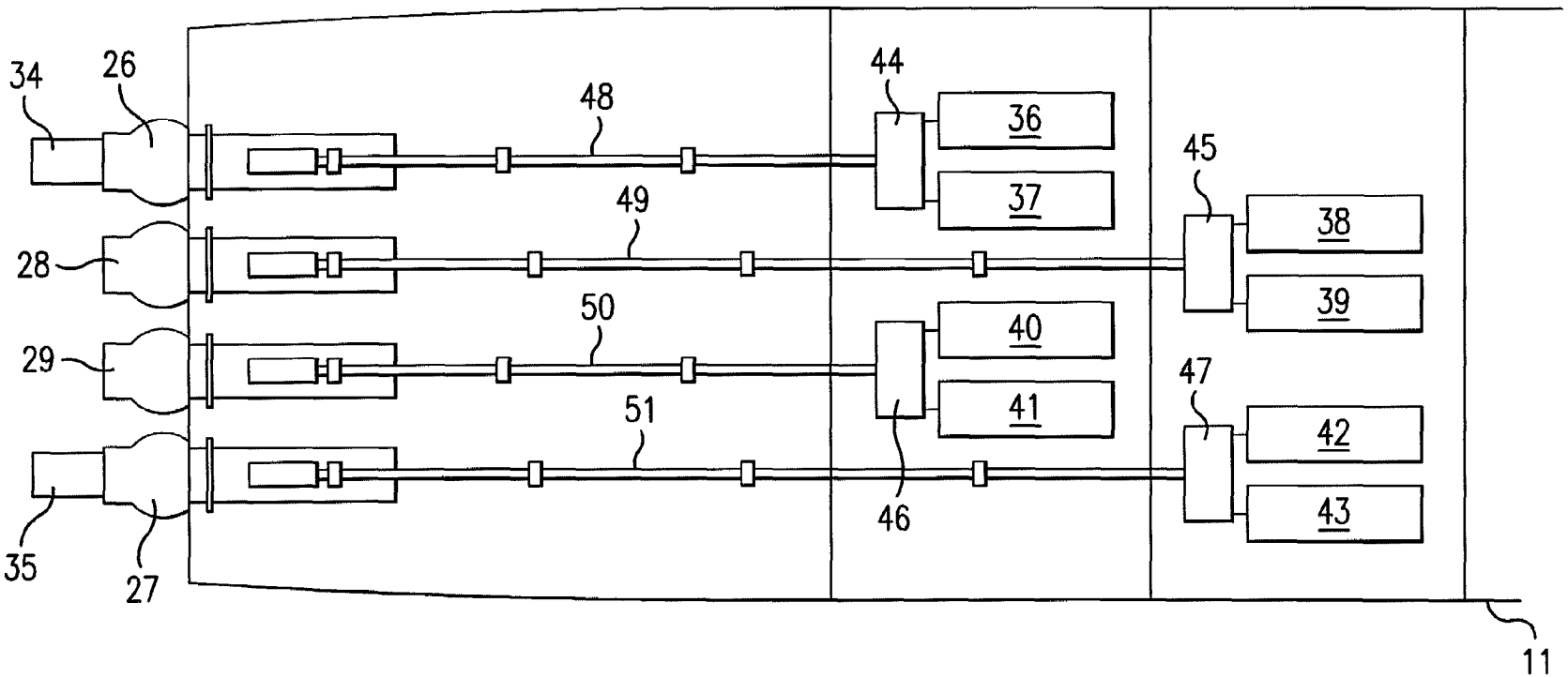
FIG. 5 PRIOR ART
Figure 15:
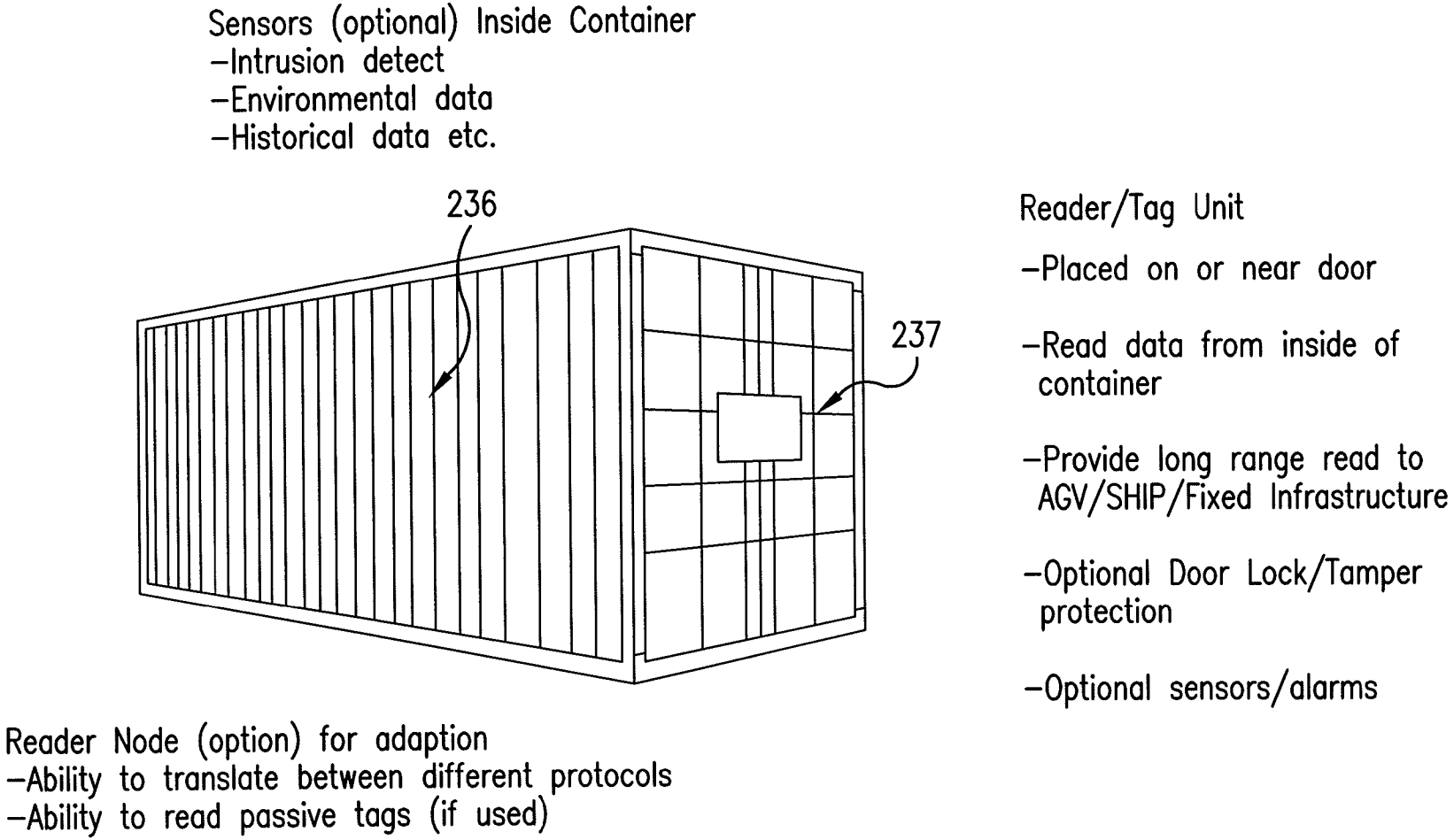
FIG. 15 illustrates a tag unit placed on an outer door of one of the containers shown in FIGS. 8-14 or other unit of cargo transported on the vehicle in FIGS. 8-14, the tag unit identifying and monitoring the container or cargo unit contents for database, temperature, chemical health, alarms, cargo history log, detection of tampering etc., which can then be reported direct to authorities from the ship or vehicle.

FIGS. 4 and 5 illustrates schematically a water jet/gas turbine propulsion system of the ship. In particular, four waterjet propulsors 26, 27, 28, 29 (one of which is illustrated in FIG. 15 of the aforementioned commonly owned patents) are mounted at the transom 30 with respective inlets 31 arranged in the hull bottom just forward of the transom 30 in an area determined, on an individual hull design basis, of high pressure. Water under high pressure is directed to the impellers of the pumps 32 of the waterjets from the inlets 31. The flow of seawater is accelerated at or around the inlets 31 by the pumps 32 of the four waterjets 26, 27, 28, 29, and this flow acceleration produces additional upward dynamic lift which also increases the hull efficiency by decreasing drag.

The two outermost waterjets 26, 27 and wing waterjets for maneuvering and ahead thrust. Each of the wing waterjets 26, 27 is provided with a horizontally pivoting nozzle 34, 35, respectively, which provides angled thrust for steering. A deflector plate (not shown) directs the jet thrust forward to provide for stopping, slowing control and reversing in a known manner. Steering and reversing mechanisms are operated by hydraulic cylinders (not shown) or the like positioned on the jet units behind the transom. The hydraulic cylinders can be powered by electrical power packs provided elsewhere in the ship. The waterjet propulsion and steering system allows the vessel to be maneuvered at a standstill and also to be decelerated very rapidly.

Marine gas turbines of the type exemplified by General Electric's LM 5000 require no more than two turbines, each rated at 51,440 horsepower in 80° F. ambient conditions, per shaft line through a conventional combining gearing installation.

Eight paired conventional marine gas turbines 36/37, 38/39, 40/41, 42/43, power the waterjet propulsion units 26, 28, 29, 27, respectively, through combined gear boxes 44, 45, 46, 47 and cardan shafts 48, 49, 50, 51. Four air intakes (only two of which 52, 53 are shown in FIGS. 1 and 4) are provided for the turbines 36 through 43 and rise vertically above the main weather deck and open laterally to starboard and port in the superstructure 13 provided in the aft section. Eight vertical exhaust funnels 54, 55, 56, 57, 58, 59, 60, 61 (FIGS. 2 and 4) for each gas turbine also extend through the pilot house superstructure 13 and discharge upwardly into the atmosphere so as to minimize re-entrainment of exhaust gases. The exhaust funnels can be constructed of stainless steel and have air fed therearound through spaces in the superstructure 13 underneath the wheel house. Further details of the ship of FIGS. 1-5 are set forth in the aforementioned commonly owned U.S. patents.

The ship of the present invention illustrated in FIGS. 6 and 7 incorporates the improved hull loading efficiency described in connection with the prior art ship of FIGS. 1-5. In addition, the ship incorporates improvements described in commonly owned U.S. Pat. No. 5,832,856 wherein at least one cargo carrying deck 100 is disposed above at least one lower deck 102 on which are mounted a plurality of propulsion units 104 and associated drive structure for powering at least one water jet 106 which is located at the stern 124. The at least one water jet has an opening 108 in a high pressure area of the stern which sucks in water and discharges it from a discharge 110 generally in accordance with the above description with respect to FIGS. 1-5 and the related commonly owned U.S. patents. The particular drive lines 112 and gear boxes 114 are generally in accordance with the commonly owned U.S. patents. The weather deck 116 covers the at least one cargo carrying deck 100 to permit climate controlled conditions to be achieved in the cargo deck area which is important for valuable cargo. A plurality of air intakes 118 and exhausts 120 extend from at least one lower deck 102 in association with the at least one propulsion unit 104 upward past the at least one cargo carrying deck 100 and through the weather deck 116. As illustrated in FIG. 7, the air intakes 118 and exhaust 120 are outboard of a plurality of longitudinally extending lanes or spaces 222 on a driving surface on the deck for supporting the wheels of self-propelled, automatically guided vehicles 207, FIG. 8 which carry cargo to be loaded and unloaded from the shop. In FIG. 8, shown in exploded view, are two stacked containers 130 supported on a load carrier/platform 219 which in turn is supported on vehicle 207.

Figure 17:
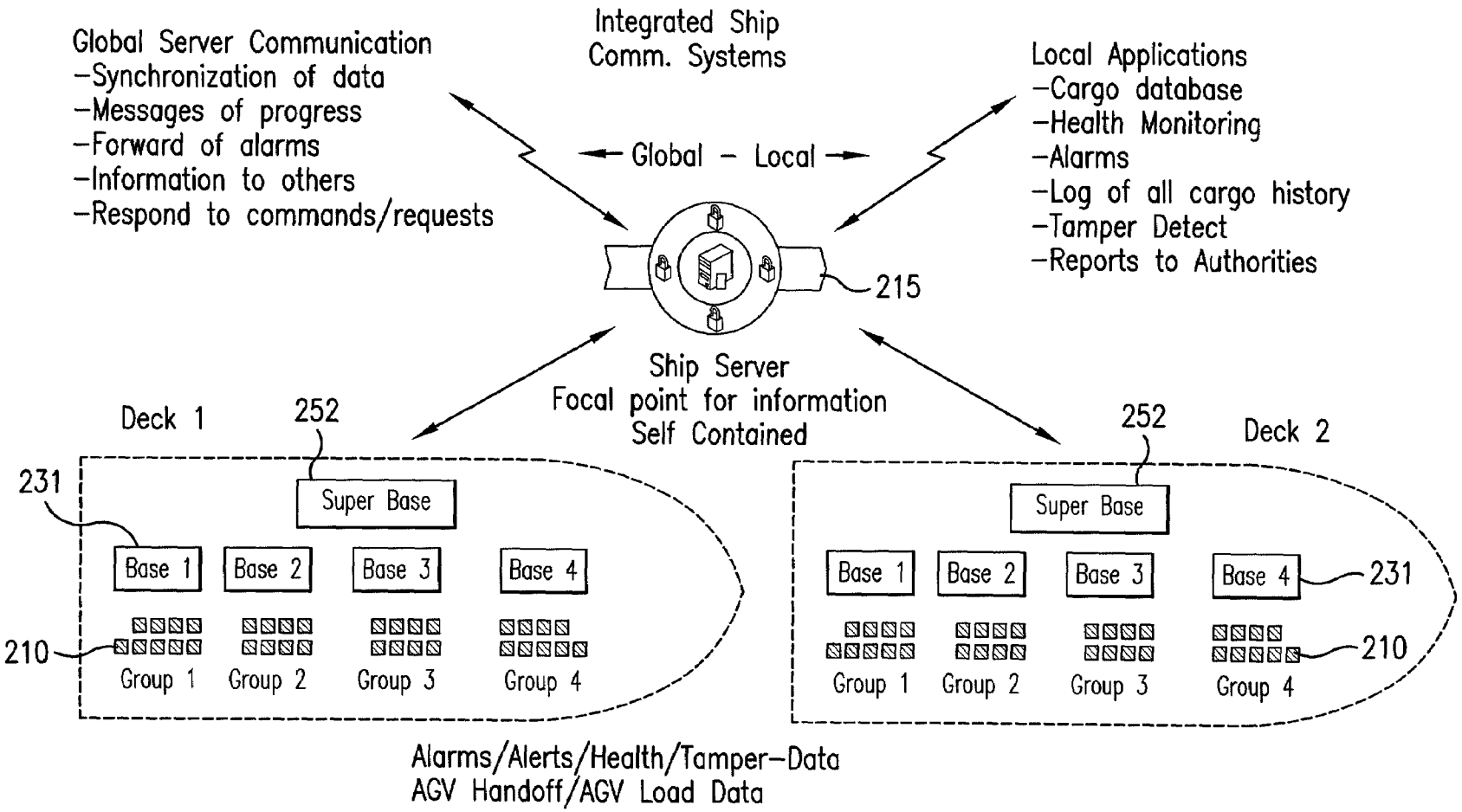
FIG. 17 is a schematic showing the tag unit on each container or cargo unit on a vehicle as shown in FIGS. 8-14 arranged in groups on each of two decks of the ship, each tag unit communicating with a reader mounted on a vehicle and being part of a group of vehicles/tag units communicating with a base station situated within the appropriate cargo deck, each base station being responsible for a row and column section of container or cargo units and communicating via a super base on each cargo deck, which is in turn linked to a ship server which communicates with global and local information centers.
Figure 18:
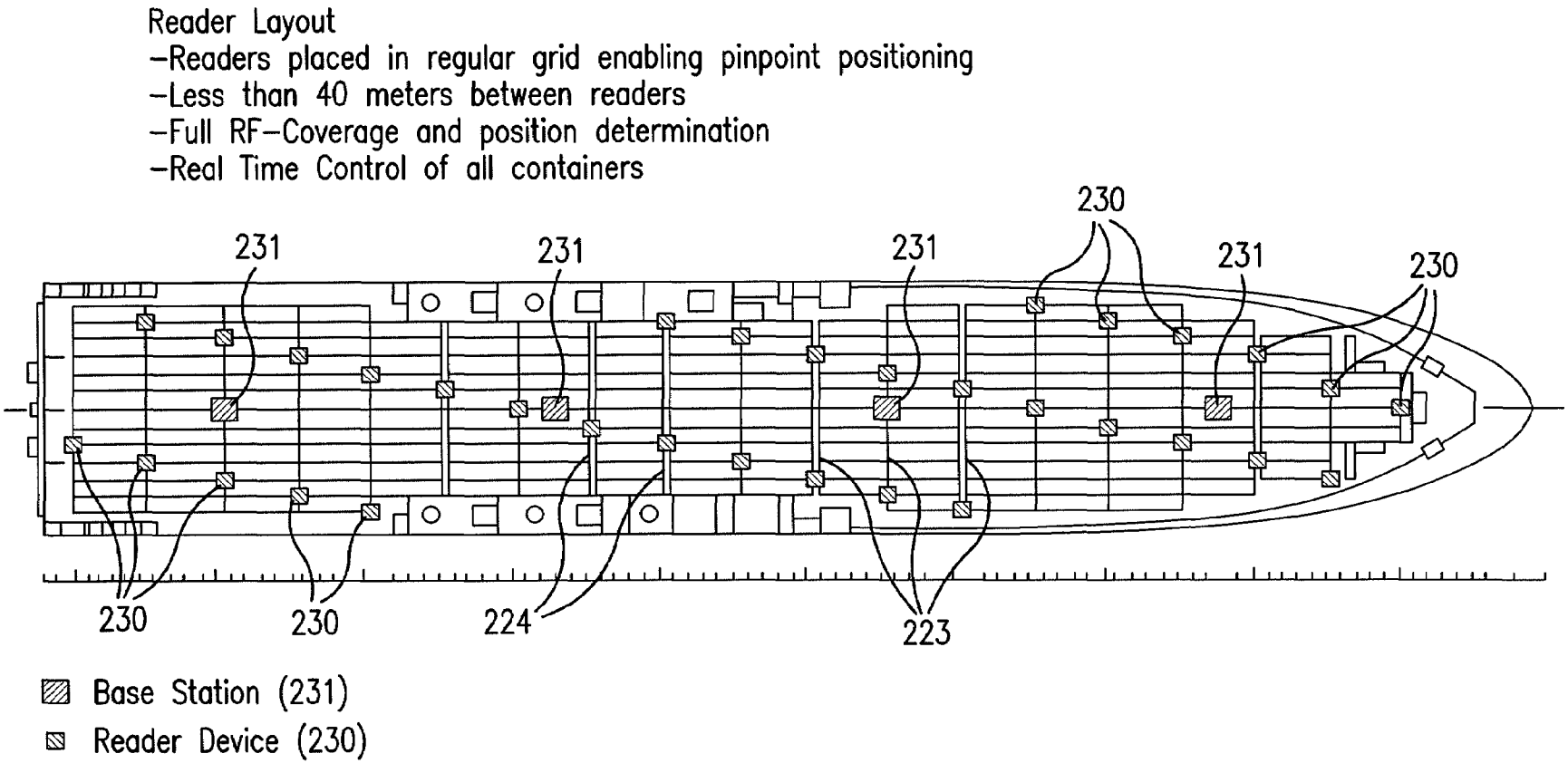
FIG. 18 illustrates the placement of readers of a reader grid mounted on transverse bulkheads on each cargo carrying deck of the ship no more than forty meters apart for reading the identification means on the containers/cargo units once handed over by the vehicles which are removed from the ship after loading, each reader of the reader grid communicating with its local base station and thus providing coverage of all of the tag units on containers or cargo units within the two cargo decks.

The lanes 222 for the vehicles 207 extend along at least one of the cargo carrying decks 100 from the stern 124 to the bow 126. Stacked containers 130 are shown on the at least one cargo carrying deck 100 in FIG. 6. Readers 230 of a ship communication system depicted in FIGS. 17 and 18 are mounted on transverse bulkheads 223 of the ship on each of the decks 100. Laser reflectors 224 for optical guidance of vehicles on the deck are also mounted about the deck, for example on the transverse bulkheads 223. The longitudinal lanes or spaces 222 are distinguished from one another by the cargo moving vehicles 207 using guidance means 225 which may, be at least one of lateral guide rails, grooves in the deck receiving electrical cable in which different frequency signals are induced, and optical means e.g. laser beams, and laser reflectors as noted above.

Figure 6:
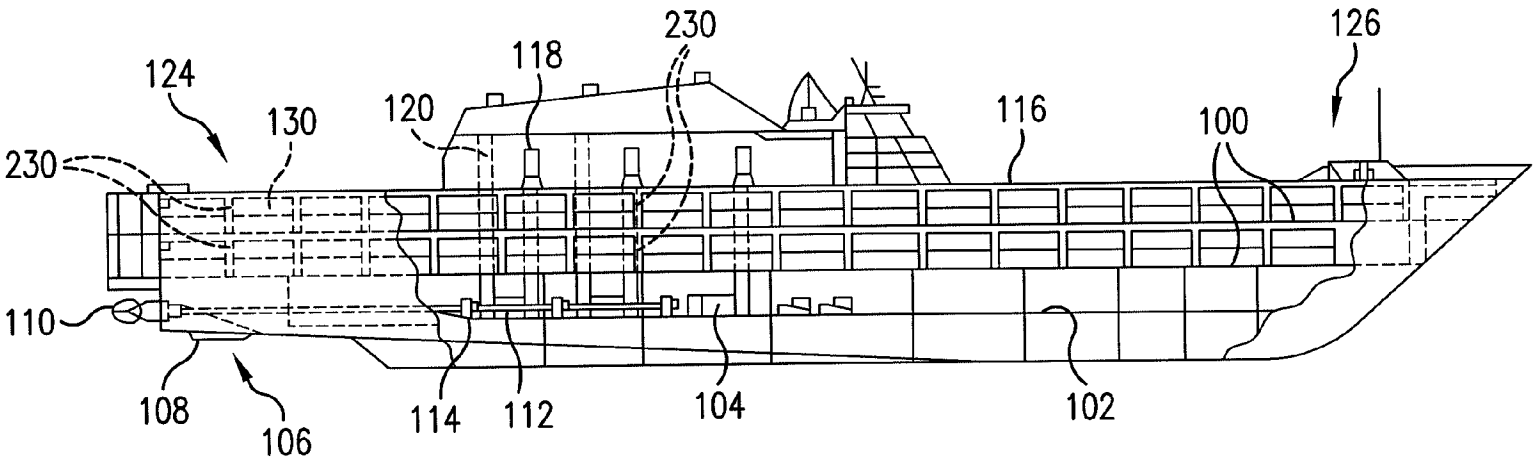
FIG. 6 is a side elevational view of a ship in accordance with the present invention.
Figure 7:
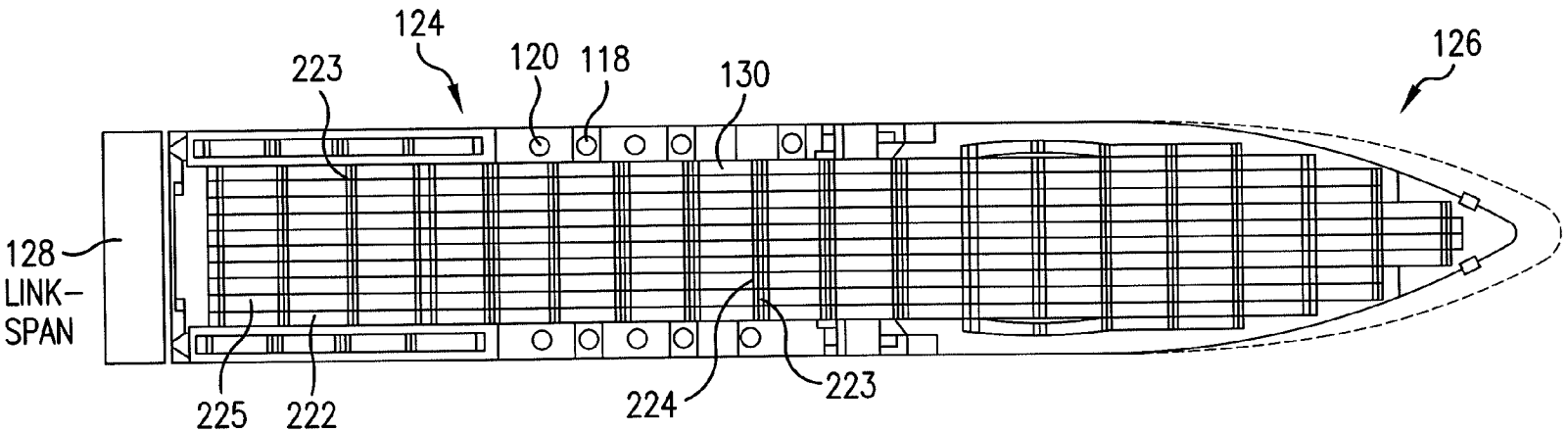
FIG. 7 is a top plan view of a cargo carrying deck of the ship of FIG. 6.
Figure 8:
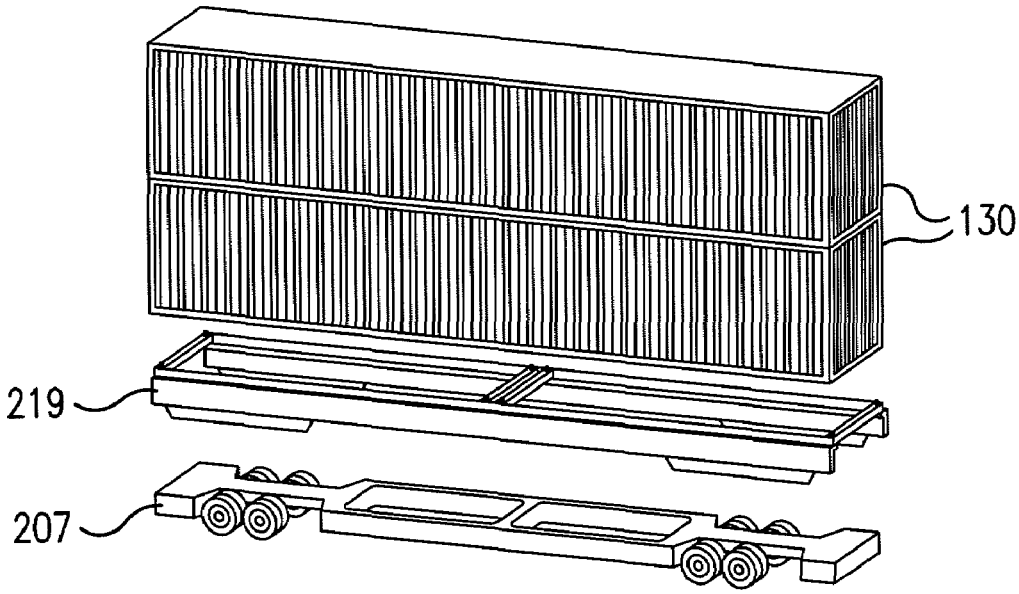
FIG. 8 shows an exploded view of a self-propelled, automatically guided vehicle with load carrier/platform and two stacked cargo containers to be transported by the vehicle.

The self-propelled, automatically guided vehicle 207 is capable of being driven between designated parking places for the purpose of transporting the cargo 130 on platform 219 between a dock, not shown, and the driving surface 222 of the at least one cargo carrying deck 100 of the ship of FIGS. 6 and 7 via a stern roll on/roll off ramp 19 and link span 128 disposed adjacent to stern 124. The vehicle 207 includes guidance means 309, FIG. 20, for performing this task automatically. The guidance means 309 are so arranged as to cause the vehicles 207 to be guided to the designated location in a line, I in FIG. 12, II in FIG. 13, and without any mechanical, electrical or other physical connection of vehicles 207 to one another, i.e., the cargo handling vehicles 207 are driving in the form of a train with a restricted train length, but without being connected together. The guidance means 309 may, for example, comprise means for laser guidance, optical guidance, cable guidance or a combination of at least two of such guidance means.

The guidance means 309 for the vehicle one of the type disclosed in U.S. Pat. No. 7,044,247 which is hereby incorporated by reference. The guidance means are arranged as to act in a transverse sense 327 viewed in relation to the intended direction of travel 326 of the vehicles, FIG. 20. The guidance means act against at least one of the deck 100 of the vessel, the transverse bulkheads 223 of the vessel, the loading ramp 19 of the ship and lateral guides 225, as described above for moving cargo in the lanes 222 on the deck driving surface defining the cargo spaces on the deck.

Data collected in respect of the relative lateral 327 position of the vehicles 207 is utilized by a unit such as a programmed computer included in the arrangement for the purpose of determining the relative positions of the vehicles in the driving line I, II in order to permit determination of the speed at which the vehicle must be driven in order to arrive at the right destination. The vehicles incorporate a unit 317, from which data from the vehicles that is first in the intended train of vehicles is transmitted to other vehicles concerning the speed, distance and positions of the vehicles.

Figure 9:
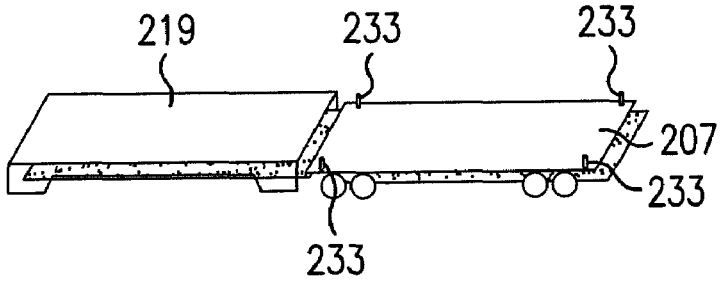
FIG. 9 shows sensors and their location on the vehicle of FIG. 8 for positioning the vehicle beneath the associated load carrier/platform.
Figure 10:
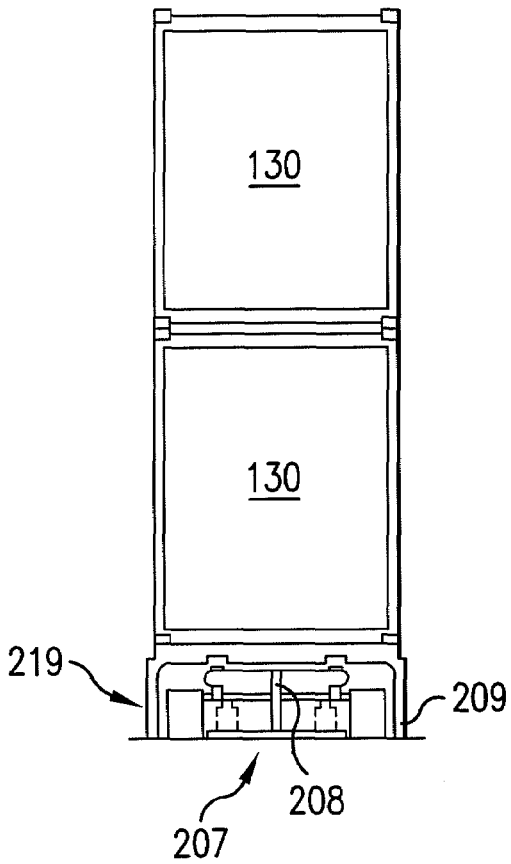
FIGS. 10 and 11 illustrate end elevational views before and after lifting cargo, that is lifting the platform and two stacked cargo containers thereon on FIG. 8, with a hydraulic jack carried by the self-propelled, automatically guided vehicle of FIG. 8.
Figure 11:
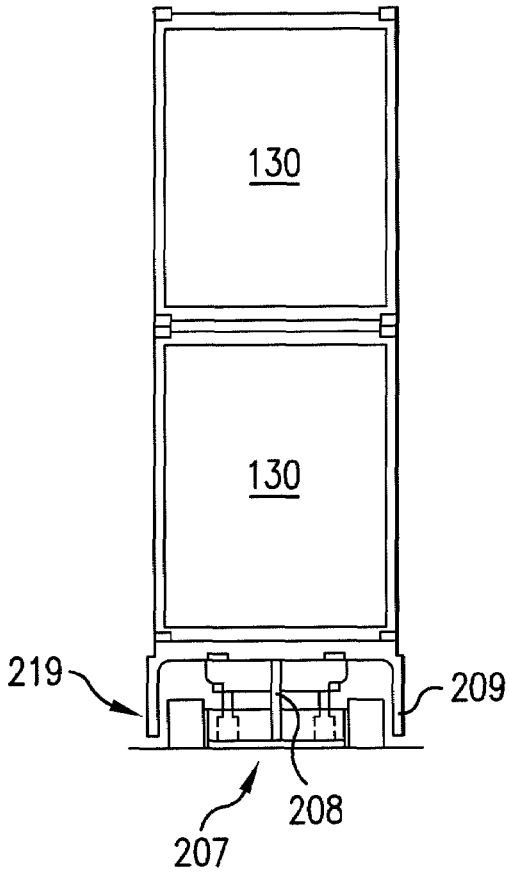
Figure 12:
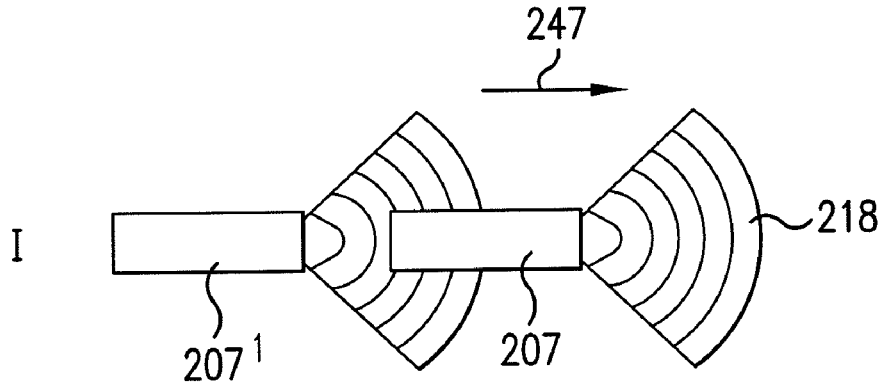
FIGS. 12 and 13 show vehicles in accordance with the invention which are driving in a line guided at a mutual distance from one another.
Figure 13:
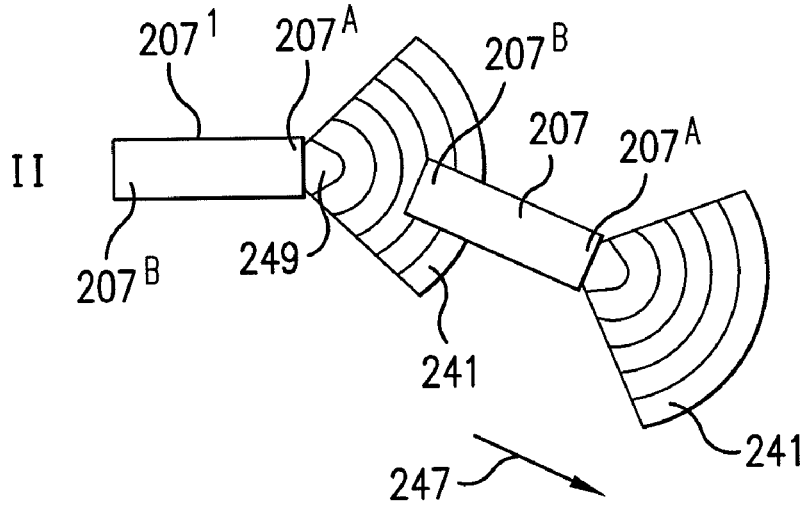

Position sensors 233, FIG. 9, on the vehicles 207 are arranged so as to determine the relative positions of the vehicles and the platforms 219 for driving the vehicle beneath the platform from where a hydraulic jack 208 of the vehicle can be actuated to lift the platform and load thereon off the deck or dock with the lower ends 209 of the platform spaced above the deck/dock for movement of the load with the vehicle. Lowering the hydraulic jack 208 permits the vehicle to be driven from beneath the platform leaving the platform with cargo at the desired location. FIGS. 10 and 11 illustrate the raised and lowered positions of the cargo on the vehicle.

Figure 19:
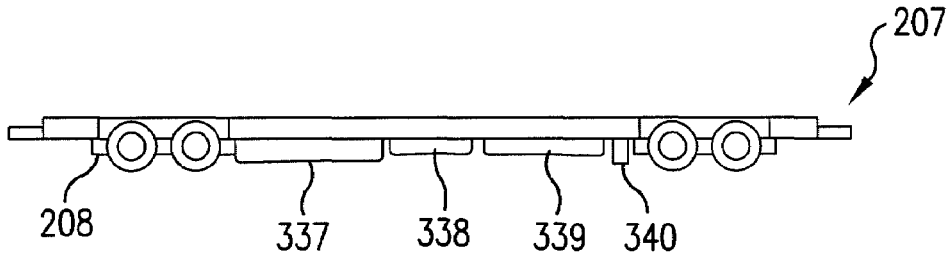
FIGS. 19-21 show the locations of sensors and other devices in the self-propelled automatically guided vehicles in accordance with the invention.
Figure 20:
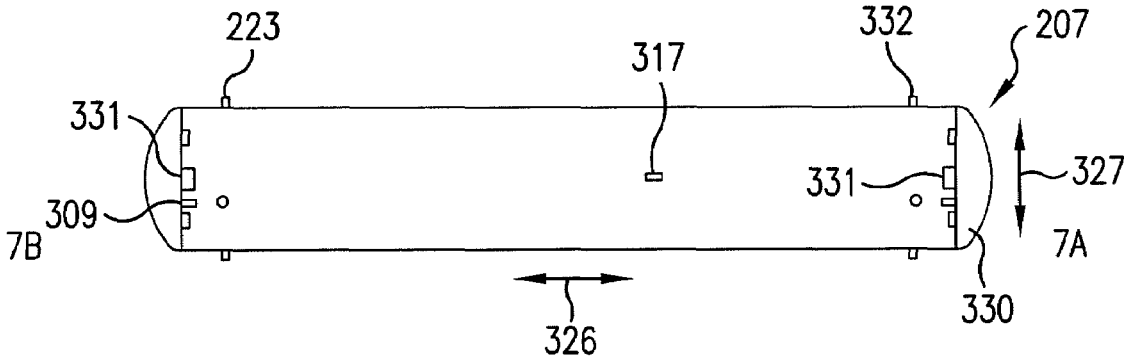
Figure 21:
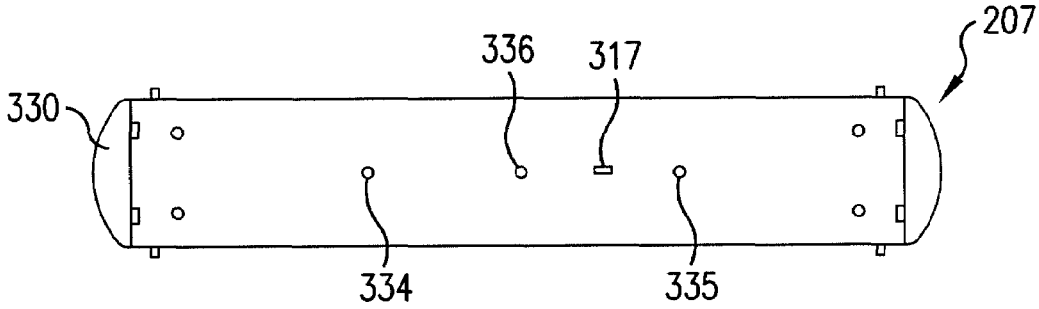

Laser sensors 331, FIG. 20, are arranged at respective ends of the vehicle 207 to sense obstructions in the intended route of the vehicle together with a digital camera 332. A preferred form of the guidance means 309 illustrated in FIGS. 12 and 13 transmits laser waves at an angle of at least 90° at the front 207A of the vehicle, viewed in the direction of travel, 326 in FIG. 20. Corresponding sensor devices, for example laser reflectors 224 are arranged at the end areas of the driving surfaces, and for example on a transverse bulkhead 223 as explained above. The vehicles are guided on the dock using transponders, transponder antenna 340 is shown in FIG. 19, which function with a global positioning system (GPS) and in the vicinity of the loading ramp of the ship they are switched to function with guidance means 309 for guiding the vehicles with load from the ramp to a predetermined point on the deck of the ship, and also in the reverse sequence and for lowering/raising their load, etc. in accordance with programmed load planning signals sent by a central control unit onboard the ship. Sensors 233, 334, 335, 336 on the vehicle are for the purpose of fine-positioning the vehicle, angular adjustment of the vehicle and as load sensors. The engine 337, fuel tank 338, vehicle control system 339 and the transponder antenna 340 are placed beneath the vehicles, FIG. 19.

Figure 14:
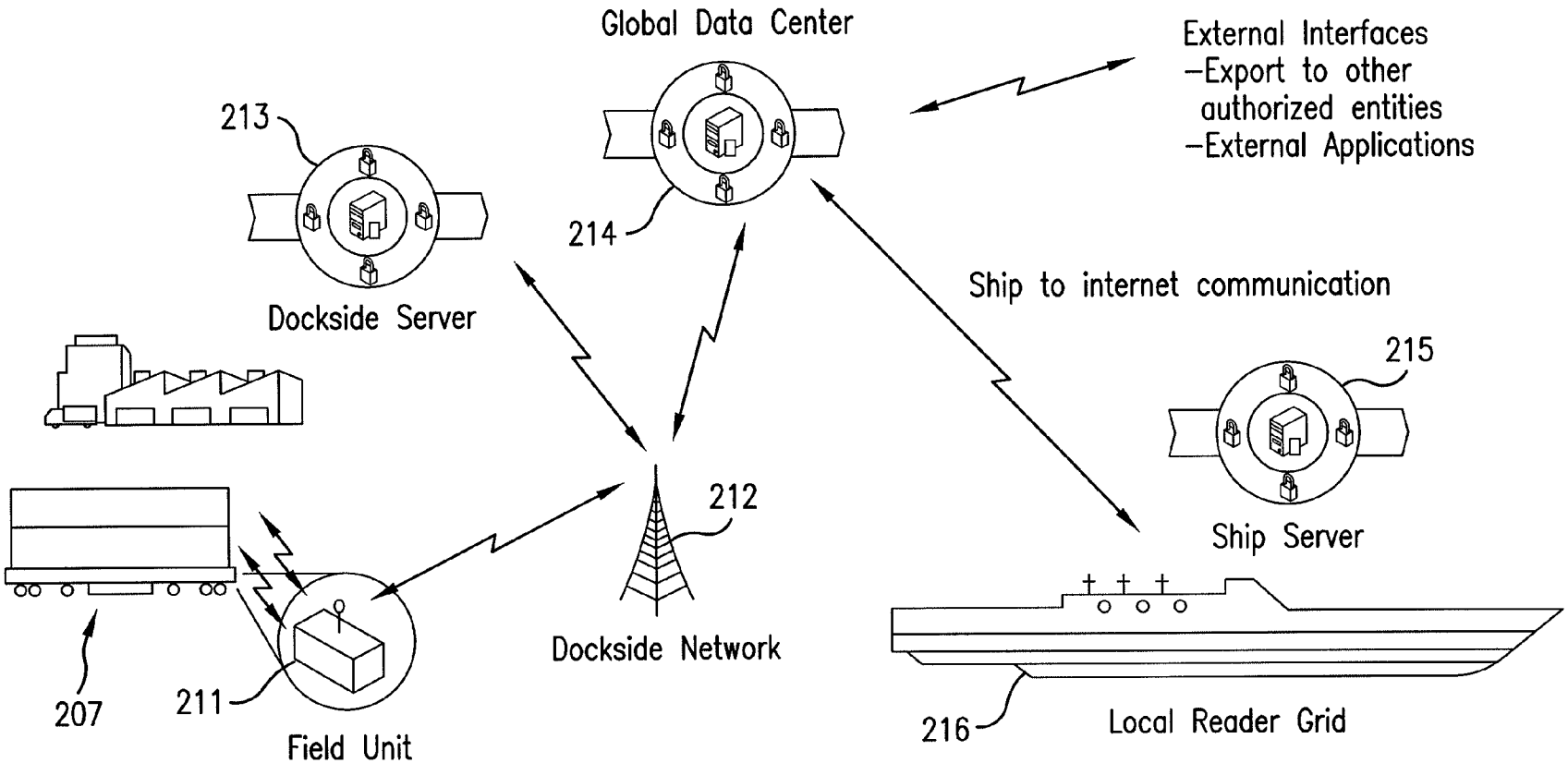
FIG. 14 is a schematic of the system of the invention showing the cargo loaded vehicle of FIGS. 8-11, each container carrying a tag unit communicating with a vehicle-mounted reader unit which in turn communicates with a vehicle-mounted field unit communicating with a dockside server, a global data center and a ship server, thus maintaining control and surveillance of the container and its contents at all times that it is in transit to and from the ship during loading and unloading.
Figure 16:
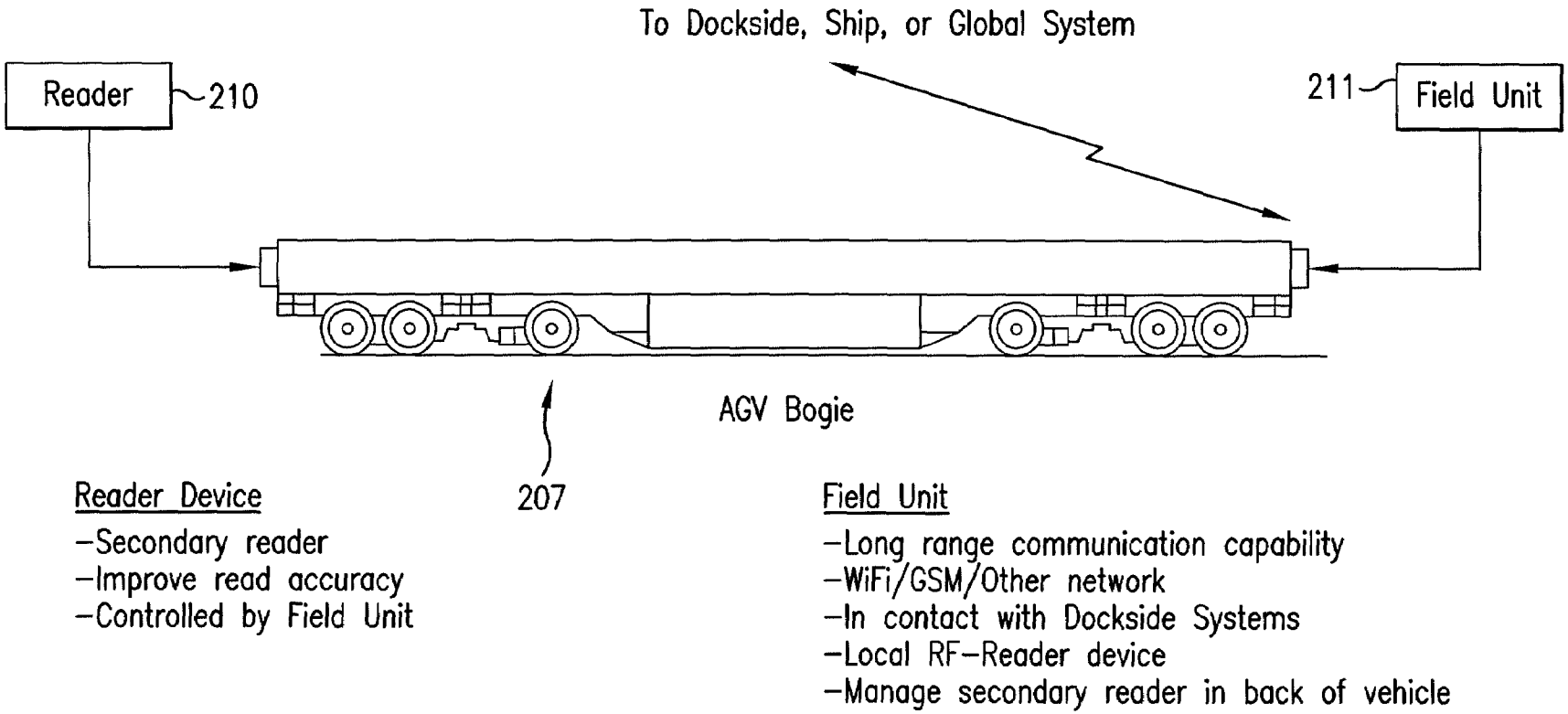
FIG. 16 illustrates the position of the field unit and reader mounted on the rubber wheeled vehicle of FIGS. 8-14.

The arrangement of the invention for loading and unloading cargo through the opening in the stern of the ship and along the driving surface of the at least one cargo carrying deck further includes a self-contained security scanning system on the at least one self-propelled automatically guided vehicle as shown schematically at 210 and 211 of FIG. 16. The scanning system maintains control and surveillance of cargo in transit on the vehicle. The security scanning system includes a reader 210 and a field unit 211 on the vehicle 207. The reader is capable of reading identification means on a cargo carried by the vehicle and in turn communicating with the field unit. The field unit is capable of communication with at least one of a ship server 215, a dockside server 213 and a global data center 214 as depicted in FIG. 14. In the example embodiment the field unit communicates with each of the ship server, dockside server and global data center by way of the dockside network 212.

The identification means on the cargo in the example embodiment is a tag unit 237 on a container which is read by the reader 210, see FIG. 15. The tag unit 237 in the example embodiment is a transponder reader/tag unit which is placed on or near a door of the container as shown in FIG. 15. The tag unit can read data from inside the container and provide long range read to the vehicle, referred to as AGV, as well as a reader grid of a ship communication system shown in FIGS. 17 and 18, and fixed infrastructure at the dock and a global data center as illustrated in FIG. 14. The reader/tag unit 237 identifies the container and optionally can provide door lock/tamper protection and sensors/alarms. Optional sensors 236 inside the container can be provided to detect intrusion, environmental data, historical data, etc. A reader node is optionally provided for adaptation, i.e. to provide ability to translate between different protocols and ability to read passive tags (if used). The reader/tag unit 237 is electronically read by remote electronic interrogation of the tag with the reader 210 on the vehicle. However, other types of tags and tag interrogation could be employed, such as with the use of optical character recognition or magnetic data interpretation.

During normal loading, the plurality of longitudinally extending lanes 222 on a deck 100 of the ship may be loaded simultaneously with trains of the vehicles 207 conveying groups of cargo containers 130 longitudinally along the individual vehicle lanes for final positioning on the floor of the deck. The location of the air intakes and air exhaust 118 and 120 outboard of the plurality of longitudinally extending lanes 222 makes possible the efficient use of the floor space of the deck which is not blocked by air intakes and air exhaust.

The ship communication system illustrated in FIGS. 17 and 18 includes a reader grid having a plurality of readers 230, FIG. 18, in different, spaced locations along each of the cargo decks for reading identification means, tag units 237, on cargo on the deck and for communicating readings from the individual cargo identification means to the ship communication system. The ship communication system further includes a ship server 215 which communicates with global and local information centers, a superbase 252 on each cargo carrying deck which is linked to the ship server and a plurality of base stations 231 in different sections on each cargo carrying deck communicating with respective ones of a plurality of groups of readers 230 of the reader grid on the deck. The readers 210 on the vehicles with cargo are shown in each of the groups on each deck in FIG. 17. The reader grid of the ship with reader devices 230 shown in FIG. 18 permits continued monitoring of the tag units of the containers after the vehicles have unloaded the cargo and been removed from the ship. Continued monitoring during sea transit is also performed by this ship communication system of the invention.

The use of the automatically guided vehicles 207 of the invention as compared with the self-propelled trolleys driven on rail pairs of the prior art greatly facilitates the process of loading, since the individual vehicles do not have to be marshaled before being assembled as was necessary with trains of the trolleys, but can be loaded randomly or in trains which can be assembled more rapidly and expediently from more widely dispersed areas of the port. The fact that the vehicles move on rubber-tired wheels, without the need for rails, means that the vessel can load and unload at any normal roll-on/roll-off port. This reduces the effect of having to change port in the event of port closure by strikes or malfunction of port facilities; and it increases the flexibilities of different ports, rather than being restricted to those with specially installed rail systems.

Furthermore, the recent substantial increase in the need for accurate security and tracking of containers and other cargo units and monitoring of their contents, has occasioned a corresponding increase in the time taken to load to unload containers and process them through port security systems which necessarily depend upon random checks. The vessel of the present invention, which carries all its cargo below decks, can therefore benefit from an on-board security scanning and tracking system applied to all containers or cargo units carried, since the various system components must be protected from the effects of corrosion, humidity, sea water immersion, extreme temperature variation and other factors which would be experienced by normal ocean-going container vessels carrying their cargo, and therefore any security scanning system, in the open air. All security and monitoring procedures can therefore be conducted while the vessel is at the sea, greatly reducing the time of taking up such measures at the dockside or in container yards in qualifying all containers or cargo carried for "green lane" security priority.

While the present invention has been described in terms of its preferred embodiments, it should be understood that numerous modifications may be made thereby without departing from the spirit and scope of the invention. It is intended that all such modifications fall within the scope of the appended claims.

I claim:

1. A system for rapid, secure transport of cargo by sea comprising:

a ship including a hull producing a high pressure area at a bottom portion of a stern which rises from a point of maximum depth forward of a longitudinal center of the hull to a point of minimum draft at a transom which produces hydrodynamic lifting of the stern at a threshold speed above a length Froude Number of 0.40;

sides of the hull at a datum waterline are non-convex in plan with reference to a centerline of the ship;

a length-to-beam ratio at the datum waterline is between 5 and 7.5 and a displacement to length ratio equal to a displacement of the hull divided by a cube of the length divided by 100 during operation of the hull in carrying fuel and payload is between 60 and 150 and a maximum operating Froude Number is between 0.42 and 0.9;

a weather deck closing a top of the hull, at least one cargo carrying deck disposed below the weather deck and having a driving surface for self propelled, automatically guided vehicles transporting cargo to and from the ship through an opening in the stern of the ship and at least one lower deck disposed below the at least one cargo carrying deck;

at least one water jet disposed within the hull with each water jet having an inlet in a bottom portion of the stern which produces high pressure during motion of the ship;

at least one power unit disposed on one of the at least one lower deck coupled to the at least one water jet for powering the at least one water jet to cause water to be drawn into the inlet of the at least one water jet to produce forward motion of the hull; and an arrangement for loading and unloading cargo through the opening in the stern of the ship and along the driving surface of the at least one cargo carrying deck, the arrangement including at least one self-propelled, automatically guided vehicle for carrying cargo to be transported during loading and unloading of the ship;

a self-contained security scanning system on the at least one vehicle for maintaining control and surveillance of cargo in transit on the vehicle;

wherein the ship includes a reader grid having a plurality of readers in different, spaced locations along the at least one cargo carrying deck for reading identification means on cargo on the deck and for communicating readings from the individual cargo identification means to a ship communication system; and wherein the ship communication system includes a ship server which communicates with global and local information centers, a super base on each cargo carrying deck which is linked to the ship server, and a plurality of base stations on each cargo carrying deck communicating with respective ones of a plurality of groups of readers of the reader grid on the cargo carrying deck.

2. The system according to claim 1, wherein the arrangement for loading and unloading further includes a plurality of platforms for supporting cargo to be transported, the at least one vehicle carrying the platforms and cargo supported on the platforms.

3. The system according to claim 1, wherein the security scanning system includes a reader and a field unit on the at least one vehicle, the reader being capable of reading identification means on a cargo carried by the vehicle and in turn communicating with the field unit, the field unit being capable of communicating with at least one of a ship server, a dockside server and global data center.

4. The system according to claim 1, wherein the ship further includes at least one exhaust and at least one air intake associated with each of the at least one power unit which extend from the at least one power unit upward past the at least one cargo carrying deck and outboard of the driving surface of the at least one cargo carrying deck.

5. A ship for rapid, secure transport of cargo by sea comprising:

a hull producing a high pressure area at a bottom portion of a stern which rises from a point of a maximum depth forward of a longitudinal center of the hull to a point of minimum draft at a transom which produces hydrodynamic lifting of the stern at a threshold speed above length Froude Number of 0.40;

sides of the hull a datum waterline are non-convex in plan with reference to a centerline of the ship;

a length-to-beam ratio at the datum waterline is between 5 and 7.5 and a displacement to length ratio equal to a displacement of the hull divided by a cube of the length divided by 100 during operation of the hull in carrying fuel and payload is between 60 and 150 and a maximum operating Froude Number is between 0.42 and 0.9;

a weather deck closing a top of the hull, at least one cargo carrying deck disposed below the weather deck and having a driving surface for self propelled, automatically guided vehicles transporting cargo to and from the ship-through an opening in the stern of the ship and at least lower deck disposed below the at least one cargo carrying deck;

at least one water jet disposed within the hull with each water jet having an inlet in a bottom portion of the stern which produces high pressure during motion of the ship;

at least one power unit disposed on one of the at least one lower deck coupled to the at least one water jet for powering the at least one water jet to cause water to be drawn into the inlet of the at least one water jet to produce forward motion of the hull;

a reader grid having a plurality of readers in different, spaced locations along the at least one cargo carrying deck for reading identification means on cargo on the deck and for communicating readings of the individual cargo identification means to a ship communication system;

wherein the shin communication system includes a ship server which communicates with global and local information centers, a super base on each cargo carrying deck which is linked to the ship server, and a plurality of base stations on each cargo carrying deck communicating with respective ones of a plurality of groups of readers of the reader grid on the cargo carrying deck.

6. The ship according to claim 5, further comprising at least one exhaust and at least one air intake associated with each of the at least one power unit which extend from the at least one power unit upward past the at least one cargo carrying deck and outboard of the driving surface of the at least one cargo carrying deck.

7. The ship according to claim 5, wherein the at least one cargo carrying deck and the driving surface of the deck extend from the opening in the stern to the bow of the ship.

8. The ship according to claim 5, wherein the driving surface includes a plurality of longitudinally extending lanes for moving and storing cargo, the lanes being distinguished from one another for automatically guided vehicles transporting cargo by at least one of lateral guide rails, grooves in the deck receiving electrical cable and optical guidance means.

9. The ship according to claim 5, further comprising guidance means on the at least one cargo carrying deck for cooperating with guidance equipment of the at least one self-propelled, automatically guided vehicle carrying cargo during loading and unloading the ship, the guidance means including at least one of guide rails, electrical cable in grooves in the at least one deck in which different frequency signals are induced, and optical guidance means.

10. An arrangement for loading and unloading cargo through an opening in a stern of a ship and along a dock and a driving surface of at least one cargo carrying deck of the ship, the arrangement comprising:

at least one self-propelled, automatically guided vehicle for carrying cargo to be transported during loading and unloading of the ship;

a self-contained security scanning system on the at least one vehicle for maintaining control and surveillance of cargo in transit on the vehicle at all times the cargo is in transit to and from the ship during loading and unloading;

wherein the security scanning system includes a reader and a field unit on the vehicle, the reader being capable of reading identification means on a cargo carried by the vehicle and in turn communicating with the field unit, the field unit being capable of communicating with a ship server, a dockside server and a global data center for maintaining control and surveillance of the cargo at all times that it is in transit to and from the shop during loading and unloading.

11. The arrangement according to claim 10, further comprising at least one platform for supporting cargo to be transported, the at least one vehicle carrying the platform and cargo supported on the platform.

12. A method for rapid, secure loading and unloading cargo on a ship comprising:

supporting cargo having identification means which can be remotely machine read on a self-propelled, automatically guided vehicle;

transporting with the vehicle the cargo supported on the vehicle on a dock, through an opening in a stern of the ship and along a driving surface of a cargo carrying deck of the ship;

reading the identification means on the cargo during the transporting with a self-contained security scanning system on the vehicle for maintaining control and surveillance of the cargo at all times that it is in transit to and from the ship during loading and unloading.

13. The method according to claim 12, including communicating the reading of the identification means from the vehicle to each of a ship server, a dockside server and a global data center.

14. The method according to claim 12, including further reading the identification means on the cargo when the cargo is on the cargo carrying deck of the ship using a reader of a reader grid along the deck and communicating the further reading to a ship communication system.

15. The method according to claim 12, wherein the identification means is a transponder tag on the cargo which is read by a radio frequency transceiver/receiver as a reader of the security scanning system.

16. The method according to claim 12, wherein the reading of the identification means is performed using at least one of remote electronic data interpretation, remote magnetic data interpretation and optical character recognition.

17. A method for rapid, secure loading and unloading cargo on a ship comprising:

supporting cargo having identification means which can be remotely machine read on a self-propelled, automatically guided vehicle;

transporting with the vehicle the cargo supported on the vehicle through an opening in a stern of the ship and along a driving surface of a cargo carrying deck of the ship;

reading the identification means on the cargo during the transporting with a self-contained security scanning system on the vehicle;

including further reading the identification means on the cargo when the cargo is on the cargo carrying deck of the ship using a reader of a reader grid along the deck and communicating the further reading to a ship communication system; and wherein the communication of the further reading to the ship communication system includes communicating the further reading from a reader of the reader grid to a base station in a section on the deck which in turn communicates the further reading to a super base on the deck which is linked to a ship server.

* * * * *